United States Patent [19]

Kunda et al.

[11] 4,129,441

[45] Dec. 12, 1978

[54] RECOVERY OF SILVER FROM SILVER CONTAINING SOLUTIONS

[75] Inventors: Wasyl Kunda, Edmonton; Roderick H. Hitesman, Fort Saskatchewan, both of Canada

[73] Assignee: Sherritt Gordon Mines Limited, Toronto, Canada

[21] Appl. No.: 766,108

[22] Filed: Feb. 7, 1977

[30] Foreign Application Priority Data

Sep. 29, 1976 [CA] Canada ..... 262288

[51] Int. Cl.[2] ..... C22B 11/00

[52] U.S. Cl. ..... 75/118 R; 75/0.5 A; 75/108

[58] Field of Search ..... 75/108, 118, 0.5 A

[56] References Cited

U.S. PATENT DOCUMENTS

| | | | |
|---|---|---|---|
| 3,833,351 | 9/1974 | Neskora et al. | 75/118 R |
| 3,877,931 | 4/1975 | Neskora et al. | 75/118 R |
| 4,039,317 | 8/1977 | Montino | 75/118 R |

*Primary Examiner*—M. J. Andrews

*Attorney, Agent, or Firm*—Robert F. Delbridge; Arne I. Fors

[57] ABSTRACT

Silver is precipitated from an aqueous sulphate solution containing dissolved silver and other metals at a temperature between about 60° C. and about 125° C. by hydrogen gas at a partial pressure between about 2 and about 5 kg/cm$^2$.

22 Claims, No Drawings

RECOVERY OF SILVER FROM SILVER CONTAINING SOLUTIONS

This invention relates to the recovery of silver from silver containing material.

It is known to recover certain metals, such as nickel, copper and cobalt, from solutions containing the metal concerned, by reducing the metal cation to the elemental metal with hydrogen gas at elevated pressure and temperature, the elemental metal consequently being precipitated.

However, the reduction of metal cations to elemental metal from an aqueous solution by hydrogen gas depends on operating conditions such as the media in which the particular metal is dissolved. For example, copper can be reduced from ammonia-ammonium carbonate solution, ammonia-ammonium sulphate solution or sulphuric acid solution, but not from ammonia-ammonium chloride solution. Nickel can be reduced from ammonia-ammonium carbonate solution, ammonia-ammonium sulphate solution and ammonia-ammonium chloride solution, but not from sulphuric acid solution. Cobalt can be reduced from ammonia-ammonium sulphate solution and ammonia-ammonium chloride solution, but not from ammonia-ammonium carbonate solution or sulphuric acid solution. The preferred pressure and temperature conditions for reduction of copper, nickel and cobalt from the above mentioned solutions are hydrogen pressure from 10 to 35 $kg/cm^2$ and temperature from 130° to 200° C.

The reduction of copper, nickel and cobalt from aqueous solution has been studied extensively over the past thirty years and preferred conditions for their reactions have been established. It has also been established that, when copper, nickel and cobalt are present simultaneously in the same solution, the selective precipitation of one metal is feasible. For example, when a solution containing copper, nickel and cobalt is treated with hydrogen at elevated temperature and pressure, copper precipitates first, followed by nickel and then by cobalt, thus offering a method for separating these metals. However, since these metals are reduced under similar conditions of temperature and hydrogen pressure, the precipitation of the metals overlaps and consequent contamination of the product occurs.

It is known too that other metals below hydrogen in the electromotive force series of elements and, in particular, the precious metals, can be reduced from solution by hydrogen. However, so far as applicant is aware, very little work has been carried out to determine effective operating conditions for such reduction reactions.

As is also known, hydrometallurgical processes for the recovery of metals have, for various reasons, become more commercially popular than pyrometallurgical processes in most instances, one of the major reasons being easier control of environmental pollution when a hydrometallurgical process is used.

In commercial metallurgy, it is becoming increasingly necessary to recover as much metal of commercial value as possible from starting materials such as ores, leach residues or scrap material. Such starting materials frequently contain significant amounts of silver, whose recovery in a sufficiently pure form at reasonable expense would be a commercial benefit. In present day hydrometallurgical processes for the recovery of metals such as nickel, copper or cobalt, the starting material is usually an ore which also contains some silver. Also, industries such as the jewelry industry produce scrap metal containing silver. Further, silver is frequently contained in waste solutions, for example, spent photographic solutions, from which the economic recovery of silver is commercially desirable.

It would therefore be useful if silver could be recovered from such material by a hydrometallurgical process, especially one including a hydrogen reduction process of the general kind mentioned above, as such a process would most likely be compatible with the processes used in a hydrometallurgical plant where other metals are recovered. From earlier remarks, it will be seen that it is not clear from the prior art whether a hydrogen reduction operation could be utilized successfully in a commercial operation for the recovery of silver in a sufficiently pure form from solutions containing silver and various other metals such as copper, nickel and cobalt.

It has now been found that silver can be preferentially reduced from solutions containing silver and other metals if the operating conditions such as temperature and pressure are controlled.

According to the present invention, silver is selectively precipitated from sulphate solutions containing silver and other metals at a temperature between about 60° C. and about 125° C. with hydrogen gas at a partial pressure between about 2 and about 5 $kg/cm^2$. Under these conditions, other metals, such as copper, nickel and cobalt, are not precipitated in any significant quantity, thus offering a method for effectively separating silver from such metals. The silver concentration in the solution is preferably between about 20 and about 120 g.p.l.

These conditions are relatively mild, that is to say the required temperature and pressure are not unduly high and, hence, are consequently readily obtainable by commercial equipment.

At temperatures above 100° C. silver is precipitated predominantly in elemental form, whereas below this temperature silver may be precipitated as silver oxide. However, if desired, the silver oxide may readily be converted to elemental silver by heat treatment in a reducing atmosphere.

The solution may also contain ammonium sulphate and free ammonia may also be present. The free ammonia to silver molar ratio may be up to 3.0 with the preferred ratio between from 0.5 to 1.0. However, the invention is broadly applicable to acid, neutral or ammoniacal solutions.

The rate of silver precipitation depends on the temperature, hydrogen pressure and free ammonia to silver molar ratio. For example, with the free ammonia to silver molar ratio in the preferred range of 0.5 to 1.0, silver can be precipitated at a rate which reduces the silver concentration in the solution from 60 g.p.l. to 3 g.p.l. in 15 minutes at 100° C. However, at a free ammonia to silver molar ratio of 2.0, a temperature of 125° C. is required to obtain the same rate of silver precipitation.

It was found that a minimum hydrogen pressure of 2 $kg/cm^2$ is required for silver precipitation, with the precipitation rate increasing with increasing hydrogen pressure. For a commercial operation, 5 $kg/cm^2$ is considered to by an upper practical limit.

Silver precipitation can be effected without a catalyst. If the precipitation of silver powder is desired as fine particles, i.e. of a size within the range of 1 to 5 microns, then an appropriate surface active reagent may be added for this purpose. Acrysol was found to be a very useful additive in this respect, the word Acrysol being a trade name for a mixture of polyacrylic acids.

The present invention is especially useful for recovering silver from silver-rich residues obtained from conventional hydrometallurgical processes for the recovery of metals such as copper and others previously mentioned. According to a further feature of the invention, such residues can be leached with concentrated sulphuric acid which dissolves silver and silver salts such as silver sulphide. The undissolved residue is separated from the resultant solution, which may then be treated by dilution with water and neutralization of excess sulphuric acid with ammonia in such a manner as to produce a solution with the limitations specified above for reduction by hydrogen gas.

Similar treatment can be carried out with elemental silver such as that contained in metal scrap.

For recovery of silver from waste solutions, such as spent photographic solutions, silver can first be precipitated from such a solution either in impure elemental form or as an impure silver salt such as silver sulphide which can then be leached with concentrated sulphuric acid in the manner described above. For example, elemental silver may be precipitated from a silver containing solution by reduction with sodium boron hydride. On the other hand, silver can be precipitated as silver sulphide from a waste solution such as a spent photographic solution by the use of hydrogen sulphide.

When treating ammoniacal solutions with hydrogen in accordance with the invention, at least some of the silver sulphate is present as silver ammine sulphate. In fact, the silver sulphate solution may be obtained by dissolving silver sulphate in ammonia solution.

Thus, the various steps required before the actual hydrogen reduction operation depend upon the nature of the starting material. Where the starting material is a residue from a hydrometallurgical operation for the recovery of a main metal, such as nickel, copper or cobalt, from mixed sulphides of these metals, the residue containing silver sulphide can be leached with excess concentrated sulphuric acid which dissolves the silver sulphide as silver sulphate. The resultant solution may then be diluted with water and the excess acid neutralized with ammonia.

An alternative method would be to precipitate silver sulphate from the resultant solution mentioned above by dilution with water, for example by about 20 to 50% by volume, filter off the precipitated silver sulphate and dissolve it in ammonia solution, which solution is then subjected to treatment by hydrogen gas. This method is especially useful for recovering silver from solutions containing a relatively high concentration of other metals. The precipitation of silver sulphate from concentrated sulphuric acid by dilution is relatively selective for silver sulphate, and salts of such metals as copper, nickel and cobalt will not precipitate in any significant quantity.

Silver containing scrap material such as scrap jewelry can be similarly treated. The temperature of the sulphuric acid should be between 120° and 200° C. to dissolve the silver. The rate of dissolution of silver in concentrated sulphuric acid increases with temperature and, hence, a higher temperature than 120° C. is to be preferred, so long as it does not approach 330° C. which is the boiling point of concentrated sulphuric acid. For commercial operations, therefore, a temperature between 150° C. and 200° C. is preferred for the dissolution of silver in concentrated sulphuric acid, and under the conditions, a silver concentration of from 500 to 600 g.p.l. can be obtained.

During the dissolution of silver in concentrated sulphuric acid, it appears that the following two reactions are taking place, with the first reaction probably predominating:

$$2Ag + 2H_2SO_4 \rightarrow Ag_2SO_4 + 2H_2O$$

$$2Ag + H_2SO_4 \rightarrow Ag_2SO_4 + H_2$$

A significant amount of sulphur dioxide and a minor amount of hydrogen are therefore released during the silver dissolution process. An excess of concentrated sulphuric acid should, of course, be used to ensure efficient dissolution of the silver.

After dissolution of silver, undissolved material should be separated from the solution, the solution diluted and excess acid neutralized. Conveniently, the excess acid may be neutralized by the addition of ammonia. Dilution with water and neutralization by ammonia produces a significantly exothermic reaction and, hence, care must be taken to avoid loss of ammonia.

The dilution of the solution is preferably such as to bring the silver concentration to between about 20 and about 120 g.p.l. However, lower or higher concentrations may be used if desired. Alternatively, the other method mentioned above, including precipitation of silver sulphate and dissolution thereof in ammonia solution, may be used.

The amount of ammonia, if any, in the solution, is preferably such that the free ammonia to silver molar ratio is from 0 to 3.0, the optimum range being from 0.5 to 1.0. Below this ratio, the pH may be so low that corrosive conditions result. Above this ratio, the precipitation rate slows down, particularly in the final stages of the reaction. The presence of ammonium sulphate in the solution does not apparently affect the reaction.

For reduction of the resultant solution by hydrogen gas, the solution is preferably heated to between 100° C. and 125° C. At lower temperatures, a significant amount of silver may be precipitated as silver oxide rather than elemental silver. Higher temperatures should be avoided because such metals as copper, nickel and cobalt, if present, may then precipitate with the silver in significant quantities.

The reduction operation can be carried out in an autoclave with hydrogen gas present at a partial pressure of between 2 and 5 kg/cm$^2$. Below this range, the reaction is undesirably slow. Higher pressures are unnecessary and would require the provision of more expensive equipment. Higher pressures may also encourage the precipitation of impurities. Efficient agitation assists the reaction, which is substantially complete after a period between 15 and 60 minutes.

Without the additive of surface active reagents, the size of the silver powder particles produced will probably be in the range of 300 to 600 microns, the size being relatively unaffected by the operating conditions, and the relatively large particles being agglomerates of much finer particles. The size of the particles can be reduced by the use of a small quantity (for example 0.1 to 0.5 g.p.l.) of surface active reagents such as Acrysol A-3, oleic acid, octylphenyl, anthraquinone and PEI 600. Acrysol is a trade name for a mixture of polyacrylic acids $(CH_2{=}CHCOOH)_x$ and PEI 600 is a trade name for polyethylamine $(C_2H_5N)_x$ with a molecular weight of the order of 40,000–60,000. In particular, it has been found that the use of Acrysol in this reaction can produce silver powder with particles mostly in the range of 1 to 5 microns.

The relatively mild conditions required for the hydrogen reduction according to the invention enables silver to be preferentially precipitated from solutions containing other metals such as copper, nickel and cobalt, which are found in residues from hydrometallurgical processes for the extraction of such metals from their ores. Some of the impurity metals may be present in the silver precipitated from the hydrogen reduction operation as entrainment from solution, and these can be removed by washing.

As mentioned earlier, the present invention can also be used of recover silver from silver containing waste solutions, such as spent photographic solutions, by first precipitating silver in elemental or salt form and then redissolving the silver to provide a solution suitable for treatment by hydrogen gas under the conditions as stated. The silver can be precipitated from such solution as elemental silver or silver salt by a reducing agent such as sodium boron hydride or hydrogen sulphide.

Sodium boron hydride can be utilized in this manner at or around atmospheric pressure, and especially in an ammoniacal medium can precipitate substantially all the silver in elemental form. After separation from the initial solution, the precipitated silver is then dissolved in concentrated sulphuric acid with consequent treatment of the resulting solution as previously indicated.

Hydrogen sulphide can also be used and, in this case, precipitates silver as silver sulphide. This can be done from ammoniacal or acid solutions. After separation, the silver sulphide is dissolved in concentrated sulphuric acid with consequent treatment of the resulting solution as preciously indicated.

Specific examples of the invention will now be described.

EXAMPLE 1

155 ml $Ag_2SO_4$ solution was mixed with 395 ml of concentrated ammonia, 67 g $NiSO_4.(NH_4)_2SO_4$, 48 g $CoSO_4.7H_2O$, 39 g $CuSO_4.5H_2O$, 44 g $ZnSO_4.7H_2O$ and the resultant solution was made up with water to 2 liters. The solution was heated in an autoclave to 100° C. and hydrogen gas was added to the autoclave at a partial pressure of 5 kg/cm$^2$ for 90 minutes.

Resultant analysis of the precipitated product showed it to be 99.6% silver. The silver product also contained 0.36% copper and <0.07% each of nickel, cobalt and zinc. Most of these impurities were entrained from solution, and were removed by washing with 0.5M $H_2SO_4$ solution, reducing their concentrations to 0.009% copper, 0.006% nickel, 0.003% cobalt, and 0.002% zinc.

These results clearly show the preferential reduction of silver from a solution containing impurity metals. Even with the excessive reaction time of 90 minutes, very little copper, nickel, cobalt and zinc were precipitated with the silver.

EXAMPLE 2

Jewelry scrap material containing silver was treated to recover the silver. The material included earring clamps, a watch casing, a ring and unidentified irregularly shaped pieces. The material weighed 197 g and analyzed as 60.5% silver, 27.6% copper, 1.2% nickel and 2% zinc as major impurities, with there also being some minor impurities, e.g. <0.5% of iron, cobalt, cadmium, chromium, lead and tin.

The scrap material was dissolved in 500 ml concentrated $H_2SO_4$ at 190° C. for 5 hours. The undissolved residue was then separated from the liquid and was found to weigh only 17.7 g. Emission spectrographic analysis showed that the undissolved pieces were principally alloys of:

1. Cu-Zn-Pb-Cd,
2. Cu-Ni-Fe-Co-Sn,
3. Cu-Ni-Zn-Pb

The silver was almost completely dissolved, and the solution contained 405 g.p.l. silver, 154 g.p.l. copper, 8.0 g.p.l. zinc and 4.1 g.p.l. nickel, with <1 g.p.l. other impurities.

The excess sulphuric acid in the solution was neutralized by adding ammonia until the pH was 8.2. The solution was then oxidized with hydrogen peroxide so as to precipitate iron, and the precipitated iron hydroxide was filtered off and found to weigh 6 g.

The purified silver solution contained 30.0 g.p.l. silver, 11.4 g.p.l. copper, 0.3 g.p.l. nickel, 0.59 g.p.l. zinc, 0.003 g.p.l. lead, 0.009 g.p.l. chromium, 0.001 g.p.l. tin and 0.0025 g.p.l. cadmium.

The solution was heated to 110° C. in an autoclave and treated with hydrogen gas at a partial pressure of 5kg/cm$^2$ to reduce the dissolved silver to elemental form. The reduction operation was continued for 2 hours to ensure that substantially all the silver was precipitated, and this lowered the silver contained in the solution from 30 g.p.l. to 0.2 g.p.l.

The precipitated product was found to contain 99.8% silver, and thus substantially all of the copper and other metals remained in solution.

Again, these results show how silver can be preferentially reduced from the solutions containing silver and other metals.

Various embodiments and specific examples of the invention have been described. Other embodiments and examples, within the scope of the invention, will be clearly apparent to one skilled in the art, the scope of the invention being defined in the appended claims.

What we claim as new and desire to protect by Letters Patent of the United States is:

1. A process for the recovery of silver from an aqueous sulphate solution containing dissolved silver and at least one other dissolved metal selected from the group consisting of copper, nickel and cobalt, including treating said solution at a temperature between about 60° C. and about 125° C. with hydrogen gas at a partial pressure between about 2 and about 5 kg/cm$^2$ to precipitate the dissolved silver without precipitating any significant quantity of said at least one other dissolved metal.

2. A process according to claim 1 wherein the silver concentration in the solution is between about 20 and about 120 g.p.l.

3. A process according to claim 1 wherein the solution contains free ammonia with a free ammonia to silver molar ratio of up to 3.0.

4. A process according to claim 3 wherein the solution contains free ammonia with a free ammonia to silver molar ratio in the range of 0.5 to 1.0.

5. A process according to claim 1 wherein the silver containing solution is prepared by steps including dissolving impure elemental silver or a silver salt in excess concentrated sulphuric acid.

6. A process according to claim 5 wherein said impure elemental silver is obtained from a silver containing solution be reduction with sodium boron hydride.

7. A process according to claim 5 wherein said silver salt is silver sulphide.

8. A process according to claim 7 wherein said silver sulphide is obtained from a silver containing solution by treatment with hydrogen sulphide.

9. A process according to claim 8 wherein said silver containing solution is spent photographic solution.

10. A process according to claim 6 wherein said silver containing solution is spent photographic solution.

11. A process according to claim 5 wherein said impure elemental silver is contained in scrap metal which is leached in said concentrated sulphuric acid.

12. A process according to claim 5 wherein a silver containing residue from a hydrometallurgical process is dissolved in the sulphuric acid.

13. A process according to claim 5 wherein the impure elemental silver or silver salt is dissolved in concentrated sulphuric acid at a temperature between 150° and 200° C.

14. A process according to claim 5 wherein, after dissolution of the silver, the resultant solution is diluted with water to precipitate silver sulphate, which is subsequently separated and dissolved in ammonia solution to provide said solution from which silver is precipitated by hydrogen gas.

15. A process according to claim 5 wherein, after dissolution of the silver, the resultant solution is diluted with water and excess acid neutralized with ammonia to provide said solution from which silver is precipitated by hydrogen gas.

16. A process according to claim 1 wherein at least some of the silver sulphate in the solution is present as silver ammine sulphate.

17. A process according to claim 1 wherein the silver sulphate solution is obtained by dissolving silver sulphate in ammonia solution.

18. A process according to claim 1 wherein the silver is precipitated from said solution at a temperature between about 100° C. and about 125° C.

19. A process according to claim 1 wherein said solution from which silver is precipitated is acidic.

20. A process according to claim 1 wherein said solution from which silver is precipitated is neutral.

21. A process according to claim 1 wherein an appropriate surface active reagent is added to said solution to cause precipitation of silver as finer particles than would otherwise be produced.

22. A process according to claim 21 wherein surface active reagent is added at a concentration in the range of from about 0.1 to about 0.5 g.p.l.

* * * * *